United States Patent [19]

Flint

[11] 4,116,026

[45] Sep. 26, 1978

[54] KEY SETTABLE, PICK PROOF LOCK

[76] Inventor: Orin Q. Flint, P.O. Box 536, Linwood, Mass. 01525

[21] Appl. No.: 787,307

[22] Filed: Apr. 14, 1977

[51] Int. Cl.[2] ..... E05B 25/00

[52] U.S. Cl. ..... 70/383

[58] Field of Search ..... 70/383, 382, 337, 340, 70/341, 342, 343

[56] References Cited

U.S. PATENT DOCUMENTS 2,113,007 4/1938 Swanson ..... 70/340

*Primary Examiner*—Robert L. Wolfe

*Attorney, Agent, or Firm*—Jerry Cohen

[57] ABSTRACT

A lock comprises separate key plug, lock plug and memory storage of a key image inserted in the key plug and transfer of the stored image to the lock plug for testing of the image at a site removed from the key plug. The key image memory and transfer mechanism comprises multiple chips offering a flexibility for key changes by any inserted key when the key plug and lock plug are in "unlocked" position. The memory is changed to the new key image. Testing is accomplished after lost motion rotation of the key plug to preclude manipulation of lock pins in the lock plug during testing of the key image (i.e., torquing of the lock plug).

5 Claims, 22 Drawing Figures

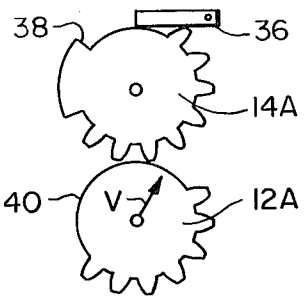
FIG. 1A
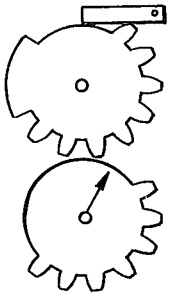
FIG. 2A
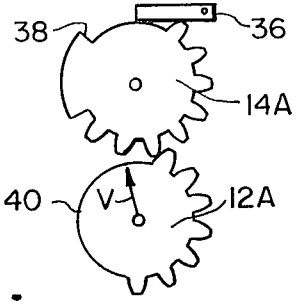
FIG. 3A
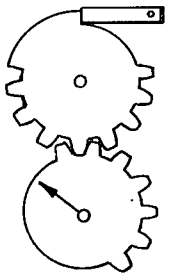
FIG. 4A
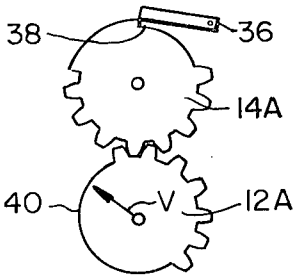
FIG. 5A
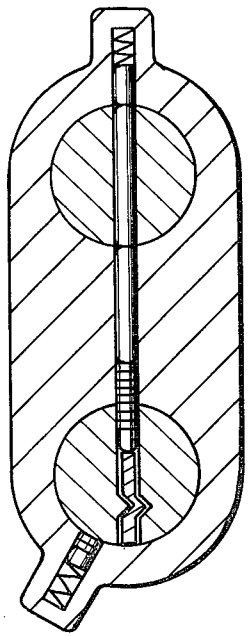
FIG. 1
FIG. 2
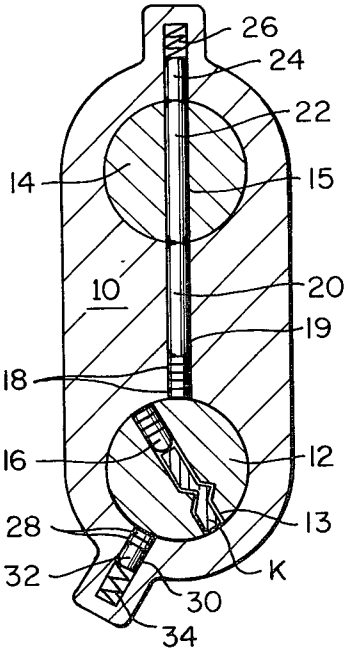
FIG. 3
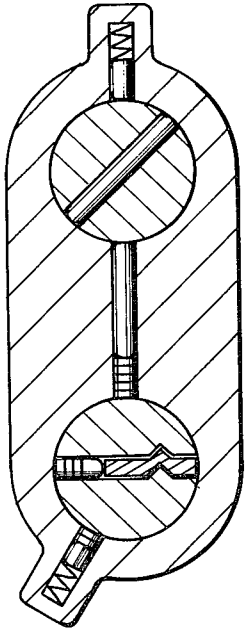
FIG. 4
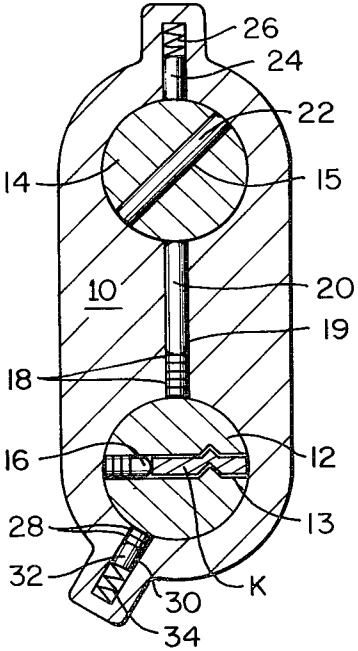
FIG. 5

KEY SETTABLE, PICK PROOF LOCK

BACKGROUND OF THE INVENTION

The present invention relates to a new type of pin tumbler lock and is particularly characterized by the unusual operating features of being pick-proof and key changeable. That is, the keying of the lock may be changed simply by inserting the new key under specified conditions. No lock disassembly is required.

Conventional pin tumbler locks can be picked because the pins may be aligned one at a time in a serial fashion, although the intention is that all pins must be aligned simultaneously to open the lock.

It is an important object of the invention to provide a pick-proof lock.

It is a further object of the invention to provide user key change capability without disassembly consistent with the preceding object.

It is a further object of the invention that serial pin setting cannot be accomplished consistent with one or both of the preceding objects.

SUMMARY OF THE INVENTION

In accordance with the invention, a lock is provided with the following operating mode, contrasted with prior art, for pick-proof protection and key change capability without disassembly. A key is inserted and the configuration of the key is 'memorized'. The memorized configuration is then 'tested'. At the time the key configuration is tested, there is no access to the lock pins, or memory and hence, they cannot be manipulated in a trial and error fashion.

The lock memory is provided in the following way: First, consider a prior art master keyed pin tumbler lock. Two keys can open the lock because there are two sets of cleavage lines (between lock pin segments). (Actually, $2^n$ different keys, where $n$ is the number of split pins, can be made which will open the lock). Now introduce another set of cleavage lines so that the lock is keyed for two master keys and a service key. This lock could be opened by $3^n$ keys. In accordance with the present invention, continue this subdivision process until all properly cut (i.e. turnable through the last motion zone) keys will open the lock. The usual longer lock pins have now been replaced by stacks of pins. When any key is inserted and rotated, the number of pins trapped in the plug in each column is a negative representation of the key, while the number of pins remaining behind in the cylinder is a positive representation of the key. Thus a representation of the key is stored in the cylinder when the key and plug are rotated and access to the pins in the cylinder is not available from the outside.

In the present invention, the stored representation of the key configuration is tested by a separate lock plug interconnected to the key plug. In one preferred embodiment the key plug and lock plug have parallel or slightly converging axes and the pin tumbler holes extend from the key plug through the cylinder to the lock plug (and through the lock plug into the cylinder again where the pin springs are located). An interlock prevents the lock plug from being turned unless the key plug is first rotated. Alternatively, the lock plug may be turned by an interconnecting means from the key plug. In another preferred embodiment, the lock plug is concentric with the key plug, i.e., the lock 'plug' is a sleeve.

In all cases, the 'memorized' configuration acts like a 'key', which sets the pins in the lock plug.

The key change feature is as follows: Assume the proper key has been inserted in the lock described above and the key plug rotated. The cleavage lines for the lock plug are properly aligned so that the lock plug may be rotated. Each column in the key plug contains a sufficient number of small pins so that the key plus the split pins fill up the columns in the plug. A different key would require, in general, a different number of pin segments to fill up each column in the plug. To change the keying, there is provided in accordance with the invention, a set of key relief holes, pin segments, and springs. The key plug, is further rotated so as to align the pin holes in the plug with the key relief holes in the cylinder. The key may then be removed. The springs in the key relief holes force columns of pin segments into the plug. Then a new key is inserted forcing back into the key relief holes, in general, a different number of split pins. The key and plug are now rotated back to the operating position. The lock is now keyed to the new key.

Access to the key change position may be controlled by a master key or by other means. For instance, in the extreme, the ability to change keys may exist only at the factory. The lock, as far as the user is concerned, is an ordinary, although pick-proof, lock. An advantage of this approach is that all locks could be made part-for-part identical and keyed by merely inserting a key. The lock sets itself to the first key inserted.

In a hotel application, lock changing ability may be under control of a master key used by the bellhop who resets the lock for each new room occupant. Since the number of times a lock will be used by an average room occupant is small, disposable plastic keys might be used. The keys could be picked at random from a large collection of pre-cut keys.

Some advantages of the invention include use of standard lock parts and keys. The keys may be standard and may be reproduced on standard key copying equipment. The key plug, driver pins, small pins, and springs, may all be standard. The cylinder or main frame has standard tolerance requirements.

The lock may be 'hybrid'; that is, some of the pin channels may work according to the principles of the present invention, while the other channels operate in the other manner. Ordinary master keying may be used in lieu of or in addition to key changing as indicated above.

Other objects, features and advantages of the invention will be apparent from the following detailed description of preferred embodiments thereof, taken in connection with the accompanying drawing, in which:

BRIEF DESCRIPTION OF THE DRAWING

FIGS. 1–10 are diagrammatic, cross section views of lock apparatus, with FIGS. 1A–10A being diagrams of related gearing, in accordance with a first preferred embodiment of the invention

DETAILED DESCRIPTION OF PREFERRED EMBODIMENTS

Figure 1B:
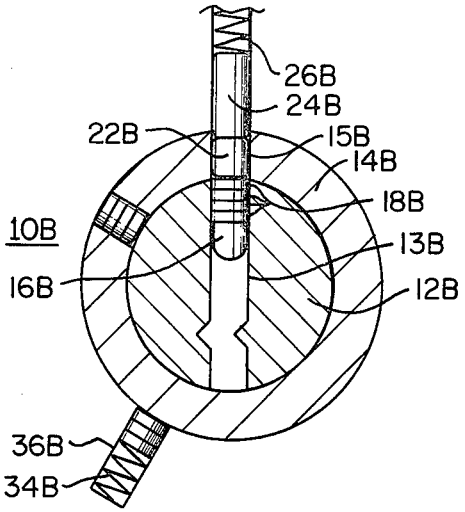
FIGS. 1B–1C show a second preferred embodiment.

FIGS. 1–4, together with FIGS. 1A–4A, show a preferred embodiment of the lock of the invention at different stages of locking and FIGS. 5–10, together with FIGS. 5A–10A, show lock changing therefor. The structure of this embodiment comprises a lock body 10, key plug 12, key plug channel 13, lock plug 14, lock plug channel 15, key pin 16, chips 18, body channel 19, connecting pin 20, lock pin 22, driver pin 24, spring 26, stored chips 28, storage channel 30, storage driver pin 32, spring 34.

While there will usually be a plurality of chips 18, a single one may be used to constitute a binary lock. Additionally, a gear 12A is interconnected to key plug 12 to rotate with it and a gear 14A is interconnected to lock plug 14 to rotate with it. Gears 12A and 14A have partial toothing for some degree of relative lost motion. A master latch 36 engages a stop 38 on gear 14A to limit motion thereof. A master pin type key or other means (not shown) can push master latch 36 aside to allow key changing action. An arrow V shows relative rotational position from figure to figure.

FIGS. 1–1A show the apparatus locked position. Eight chips 18 are in channel 13/19 and two chips 28 (for lock change purposes) are in channel 30. FIGS. 2–2A show the same position with insertion of a key K raising chips 18 to transfer more of them from channel 13 to 19 and, if the key is correct, raising connecting pin 19 and lock pin 15 to the point that the cleavage line therebetween coincides with the circumference of the lock plug so that the latter can rotate.

FIGS. 3–3A show that the user rotates key plug 12 using key K and taking advantage of the relative lost motion between gears 12A and 14A. The chips 18 stored in channel 19 constitute a positive remembered image of the key bond which raised them there.

FIGS. 4–4A show that further counterclockwise motion of gear 12A past the last motion portion rotates gear 14A so that stop portion 38 of gear 14A engages stop lever 36, a door latch (not shown) is connected to gear 14A and rotates therewith so that in the FIG. 4–4A position of the gear, the latch unlocks the door. The key is then removed. To lock the door, the sequence is reversed.

Figure 9A:
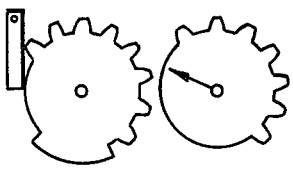
Figure 9:
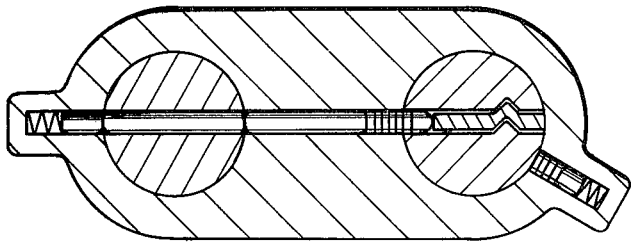
Figure 8A:
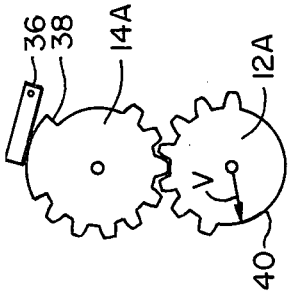
Figure 8:
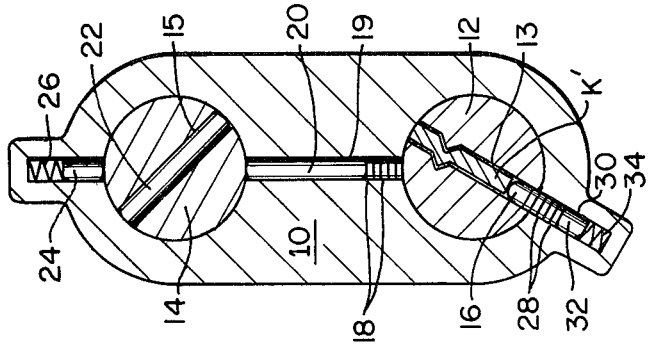
Figure 7A:
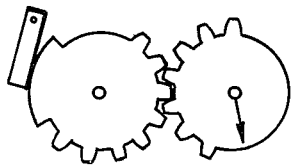
Figure 7:
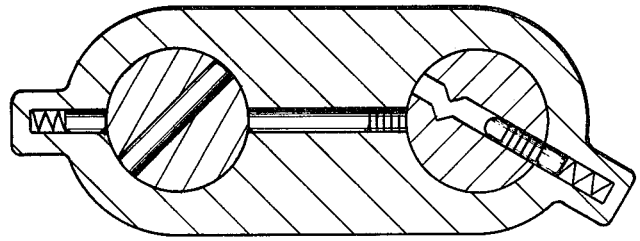
Figure 6A:
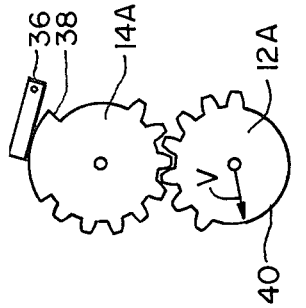
Figure 6:
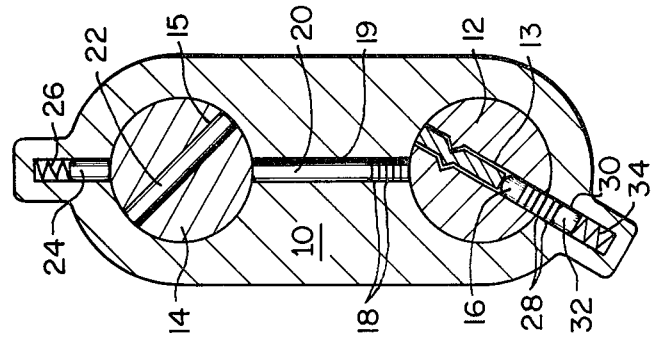

Referring now to FIGS. 5–5A, the key change operation is enabled by lifting lever 36 and turning the existing key (for which the lock is set) from the FIG. 4–4A position to rotate key plug 12 further counterclockwise to align key channel 13 with storage channel 30 (FIGS. 6–6A. Key K is then removed (FIGS. 7–7A) and new key K′ is inserted (FIGS. 8–8A) resetting the lock for key K′. Key K′ is operated to rotate plug 12 clockwise to the position of FIGS. 9–9A and key K′ is then removed (FIGS. 10–10A) and the lock is reset with six chips in channel 13/19 and four chips in storage channel 30.

FIG. 1B shows a concentric variant from the FIG. 1–10 and 1A–10A embodiment comprising a key plug 12B, with key channel 13B therein; an annular lock plug 14B with channel 15B; chips 18B residing in the channels or being storable in a channel 36B of fixed structure 10B. A spring 34B is provided in the storage channel. A lock pin 22B, a reaction force drives pin 24B and a spring 26B complete the structure.

Figure 1C:
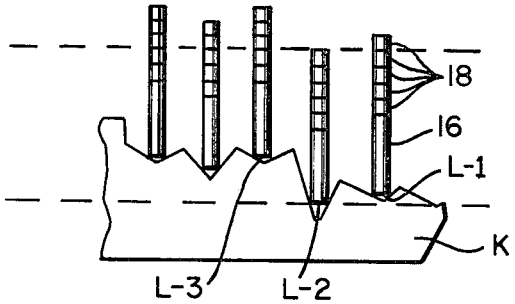
Figure 10A:
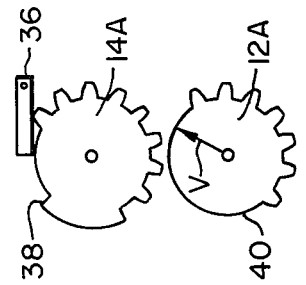
Figure 10:
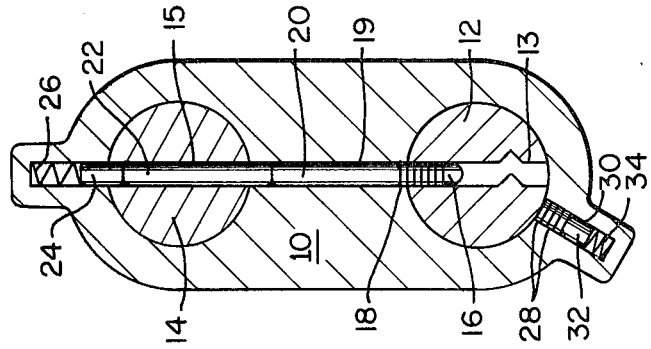

FIG. 1C is a cross section view of the lug relevant to both FIGS. 1–8 (including 1A–8A) and FIG. 1B species and shows the multiple lands L-1, L-2, L-3, etc., of a key K, each driving chip 18 (or 18B) arrays in accordance with the approach of either species defined above or equivalents. CL indicates a key plug of rotation which usually (though not necessarily) coincides with a geometric outer of the key plug and P indicates the parting line between key plug and lock plug (See FIG. 1B) or between key plug and fixed structure (FIGS. 1–8).

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Key settable, pick-proof lock, comprising, in combination, means forming a movable key plug with a locking channel, means defining at least one array of a plurality of key chips movably mounted within said locking channel for resting on a land of a key inserted into said channel, means defining a movable lock plug with a channel therein means defining surrounding lock body structure containing said key plug and lock plug, means forming a lock pin movably arranged within said lock plug channel and being movable between a first position extending partly out of said lock plug channel and engaging the body to lock the lock plug and a second position wholly within the channel to unlock the lock plug, first means-for-interconnecting the key chips with the locking channel such that when the array of chips is moved to predetermined height by a predetermined key land height, then the chips in turn act through said first means-for-interconnecting to allow movement of the lock pin from locking to unlocking position, means for interconnecting the lock plug to a latch so that unlocking the lock plug and moving it in turn releases the latch and means for moving the lock plug when unlocked, lost motion interconnection means between said plugs allowing initial key plug movement to separate chips in said body channel from chips in said key plug channel before lock plug movement can be attempted to test the control key image of chips stacked in the body channel, the chips having a control key image that works in response to correct service key insertion in the key plug, means in said lock body structure for storing chips, and, second means-for-interconnecting said storage means and key plug channel for chip transfer to change the lock setting, said second means-for-interconnecting being operable by a present correct service key and accomodatable to a new service key to effect such chip transfer.

2. Lock in accordance with claim 1 wherein the key plug and lock plug are concentrically arranged.

3. Lock in accordance with claim 1 wherein the key plug and lock plug are separately mounted within said lock body structure.

4. Lock in accordance with claim 1 and further comprising auxiliary lock means for barring access to the key change position.

5. Key settable, pick-proof lock, comprising, in combination, means forming a movable key plug with a locking channel, means defining at least one key chip movably mounted within said locking channel for resting on a land of a key inserted into said channel, means defining a movable lock plug with a channel therein, means defining surrounding lock body structure containing said key plug and lock plug, means forming a lock pin movably arranged within said lock plug channel and being movable between a first position extending partly out of said lock plug channel and engaging the body to lock the lock plug and a second position wholly within the channel to unlock the lock plug, first means-for-interconnecting the key chips with the locking channel such that when the chip or chips is moved to a predetermined height by a predetermined key land height, then the chip or chips in turn act through said first means-for-interconnecting to allow movement of the lock pin from locking to unlocking position, means for interconnecting the lock plug to a latch so that unlocking the lock plug and moving it in turn releases the latch and means for moving the lock plug when unlocked, lost motion interconnection means between said plugs allowing initial key plug movement to separate chips in said body channel from chips in said key plug channel before lock plug movement can be attempted to test the control key image of chips stacked in the body channel, the chips having a control key image that works in response to correct service key insertion in the key plug, means in said lock body structure for storing chips, and, second means-for-interconnecting said storage means and key plug channel for chip transfer to change the lock setting, said second means-for-interconnecting being operable by a present correct service key and accomodatable to a new service key to effect such chip transfer.

* * * * *